United States Patent [19]

Shoemaker

[11] Patent Number: 4,640,562

[45] Date of Patent: Feb. 3, 1987

[54] SURFACE MOUNTING MEANS FOR PRINTED CIRCUIT BOARD

[75] Inventor: John R. Shoemaker, Reidsville, N.C.

[73] Assignee: AMP Incorporated, Harrisburg, Pa.

[21] Appl. No.: 828,576

[22] Filed: Feb. 10, 1986

Related U.S. Application Data

[63] Continuation of Ser. No. 683,538, Dec. 19, 1984, abandoned.

[51] Int. Cl.[4] ..... H01R 9/07

[52] U.S. Cl. ..... 339/17 F; 339/75 MP; 339/91 R

[58] Field of Search ..... 339/17 F, 17 C, 17 L, 339/17 CF, 91 R, 75 M, 75 MP, 126 R, 174, 176 MP

[56] References Cited

U.S. PATENT DOCUMENTS

| | | | |
|---|---|---|---|
| 3,101,230 | 8/1963 | Bausch et al. | 339/91 R |
| 3,149,897 | 9/1964 | Martineck | 339/17 F |
| 3,216,580 | 11/1965 | Fricker, Jr. | 339/75 MP |
| 3,651,446 | 3/1972 | Sadogierski et al. | 339/126 R |
| 3,932,934 | 1/1976 | Lunch et al. | 29/628 |
| 4,072,387 | 2/1978 | Sochor | 339/176 MF |
| 4,173,387 | 11/1979 | Zell | 339/196 M |
| 4,222,624 | 9/1980 | Eme et al. | 339/75 M |
| 4,273,399 | 6/1981 | Myers et al. | 339/17 C |
| 4,363,529 | 12/1982 | Loose | 339/17 C |
| 4,412,714 | 11/1983 | Morningstar et al. | 339/91 R |
| 4,417,779 | 11/1983 | Wilson | 339/75 MP |
| 4,436,358 | 3/1984 | Coldren et al. | 339/17 C |

*Primary Examiner*—Neil Abrams

*Attorney, Agent, or Firm*—Katherine A. Nelson

[57] ABSTRACT

A surface mounting means is disclosed which is adapted to releasably mount an electrical component to the surface of a printed circuit board. In one specific embodiment, the electrical component comprises an electrical connector for interconnecting a plurality of conductors on the circuit board to a like number of conductors in a flexible flat cable. The connector includes a plurality of U-shaped terminals which define generally parallel legs, with one of the legs of each terminal being biased into contact with a conductor in the flexible cable, and the other of the legs being biased into contact with a conductor on the circuit board. The connector is releasably mounted to the surface of the board by means of a pair of retainers, which include spring arms which are adapted to releasably engage the end portions of the connector.

21 Claims, 10 Drawing Figures

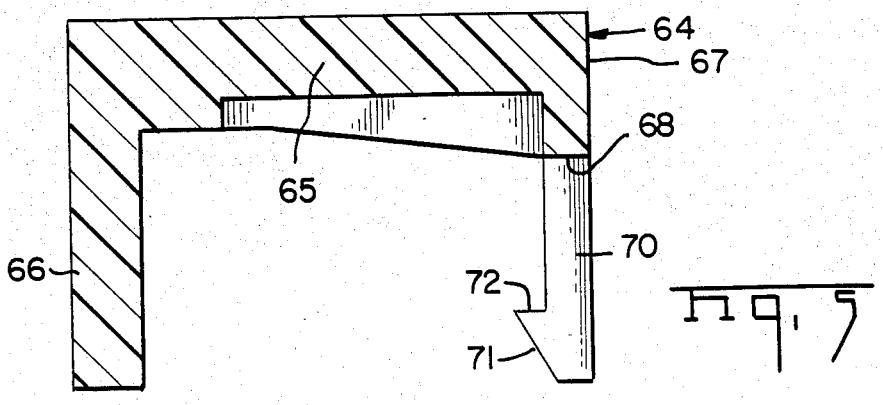
Fig. 5
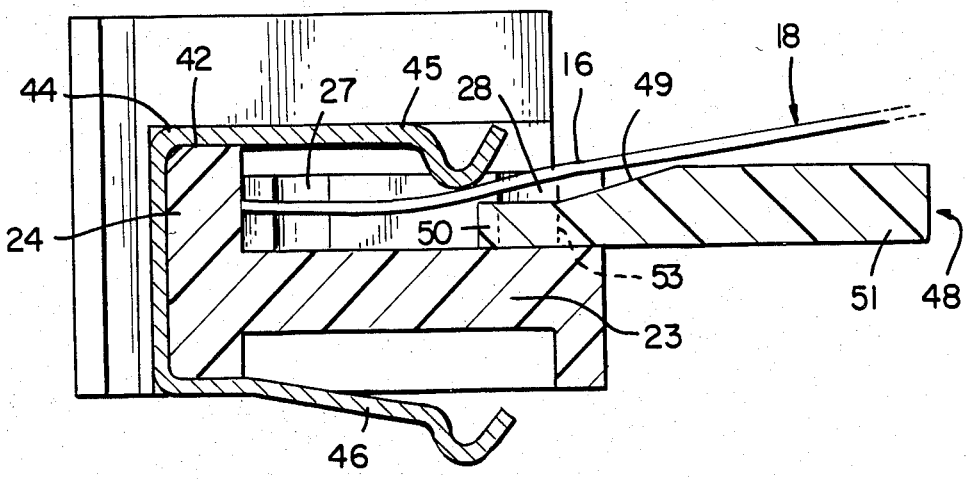
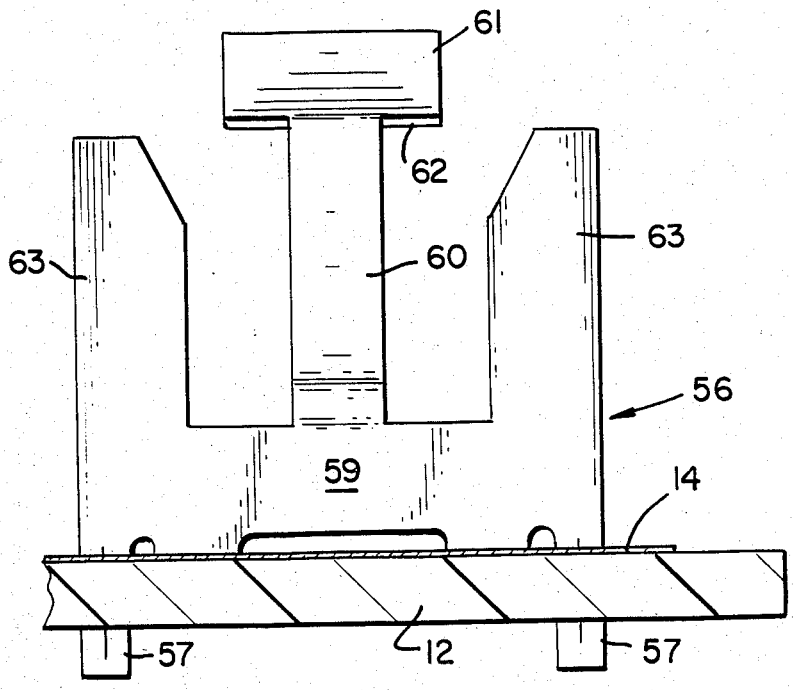

SURFACE MOUNTING MEANS FOR PRINTED CIRCUIT BOARD

This application is a continuation of application Ser. No. 683,538, filed Dec. 19, 1984, now abandoned.

The present invention relates to surface mounting means for mounting an electrical component to the surface of a printed circuit board.

Electrical components, such as post headers and connectors of various types, are commonly mounted to a printed circuit board by initially drilling a large number of holes in the board, with the holes being adapted to respectively receive posts or pins formed on the component. The posts or pins of the components are then aligned with and inserted through the holes, and finally, the posts or pins are soldered in place. This procedure results in the necessity of drilling a large number of holes in the board, and it is often difficult to align the posts or pins of the components with the holes during the assembly operation. Further, the mass soldering of the large number of posts or pins requires substantial amounts of solder, and imparts a great deal of heat to the board and the components.

In an effort to eliminate or at least reduce the above problems, it has more recently been proposed to mount components directly to the surface of the board by means of epoxy or other adhesive. Where the joined component includes terminals which are to be electrically joined to the circuit conductors on the board, the component will for example include laterally directed terminal tails which are joined to the circuit conductors during the reflow soldering process. More particularly, circuit boards are conventionally subjected to a final soldering operation, commonly referred to as reflow soldering, wherein the entire board is subjected to a temperature of about 400 degrees Fahrenheit or higher, for the purpose of remelting all of the soldered joints to insure their proper interconnection. Thus, in the case of surface mounting techniques, the reflow soldering process is used to join the terminal tails of the components to the conductors on the board.

While surface mounting techniques are able to alleviate many of the problems associated with the more common drilling and soldering processes, there remain certain limitations and disadvantages. In particular, all of the joined components are subjected to high temperature during the reflow soldering process, which requires that all components be fabricated from heat resistant plastics or other materials, which are relatively expensive. Also, it is generally required that all of the components be mounted so as to be spaced above the board to permit the cleaning and removal of all flux after the reflow soldering process, and this complicates the mounting process. Still further, the terminal tails of the components often bend from the heat of the reflow soldering process, causing them to lift from contact with the conductor on the board, resulting in an open or high resistance solder joint.

It is accordingly an object of the present invention to provide a surface mounting means for mounting an electrical component on the surface of a printed circuit board, and which effectively avoids the above noted disadvantages and limitations of the prior art practices.

It is a more particular object of the present invention to provide a surface mounting means of the described type, and which avoids the need to drill a large number of holes in the board, and the step of aligning a large number of posts or pins with individual holes during the assembly of the component on the board.

It is a further specific object of the present invention to provide a surface mounting means of the described type which avoids excessive soldering of the components of the circuit board so as to avoid possible heat damage to the board or the connector, and more particularly, to a surface mounting means which permits the component to be mounted on the board after the reflow soldering operation, and so that the component is not subjected to the heat of such operation. For this reason, the component may be fabricated from a less expensive plastic material.

It is still another object of the present invention to provide a surface mounting means for an electrical connector having a plurality of terminals to be joined to conductors on the board, and wherein the mounting requires no soldering of the terminals to the board, and wherein the connector is releasably connected to the board so as to permit its subsequent removal and replacement.

These and other objects and advantages of the present invention are achieved in the embodiment illustrated herein by the provision of a surface mounting means adapted for releasably mounting an electrical component on the surface of a printed circuit board or the like, and which comprises a retainer composed of an integral, relatively thin sheet of material, and which includes a lower edge portion which has legs or other means for contacting and being fixedly mounted to the surface of the board. The retainer further includes spring arm means extending upwardly from the lower edge portion, and an inclined surface portion at the upper free end thereof. Further, there is provided upstanding side arms extending upwardly from the lower edge portion in spaced relation on each side of the spring arm means.

The above described retainer is adapted to form an electrical assembly composed of an electrical component and a pair of such retainers, and whereby the retainers are adapted to be fixedly mounted on the surface of a circuit board in a spaced apart arrangement, and the electrical component has end portions configured to matingly engage the retainers so that the component may be releasably mounted on the surface of the board between the retainers.

The present invention also involves a unique electrical component in the form of an electrical connector, and which is adapted to be releasably mounted to a circuit board by the above described retainers. In particular, the connector comprises a body member having opposite end portions which define a longitudinal direction therebetween, and a plurality of metal terminals which are mounted in a longitudinally spaced apart and aligned arrangement, and with each of the terminals having an upper leg and a lower leg. The upper legs define an upper row of legs which are adapted to be electrically connected to respective ones of the parallel conductors in a flexible flat cable or the like, and the lower legs define a row of legs which extend below the connector. Each of the end portions of the connector includes extensions which are adapted to matingly engage the retainers so as to releasably mount the connector to the circuit board.

In a preferred embodiment, the connector further includes a generally flat shelf extending longitudinally between the end portions of the body member, and the metal terminals are of generally U-shaped configuration and are mounted in a longitudinally spaced apart and aligned arrangement, with one of the legs of each terminal forming the upper row of legs which overlies the shelf, and with a second one of the legs of the terminals defining the lower row. Also, a wedge plate is provided which is adapted to be laterally inserted between the shelf and the upper row of legs.

To assemble the above described connector to a flexible flat cable and the board, the flexible flat cable is first connected to the connector by the steps of laterally inserting the end portion of the cable and the wedge plate between the shelf and the upper row of terminal legs and so that the upper row of legs engages respective ones of the exposed conductors of the cable. The resulting assembly may then be mounted on a circuit board having a row of conductors on the surface thereof, and such that the conductors on the surface of the board are respectively engaged by the lower row of terminal legs.

Some of the objects and advantages of the present invention having been stated, others will appear as the description proceeds, when taken in conjunction with the accompanying drawings, in which:

FIG. 5 is a sectional view taken substantially along the line 5—5 of FIG. 2;

Figure 8:
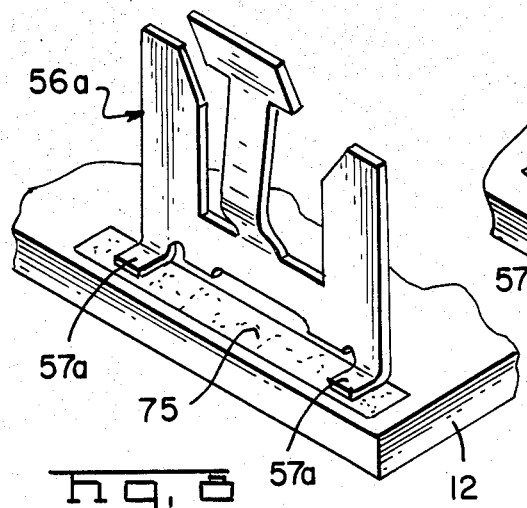
Figure 9:
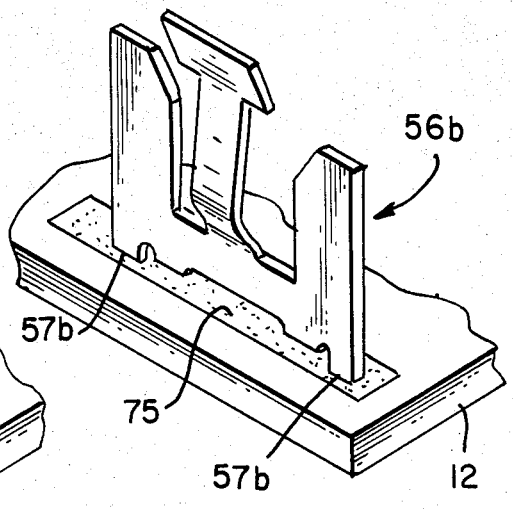
Figure 10:
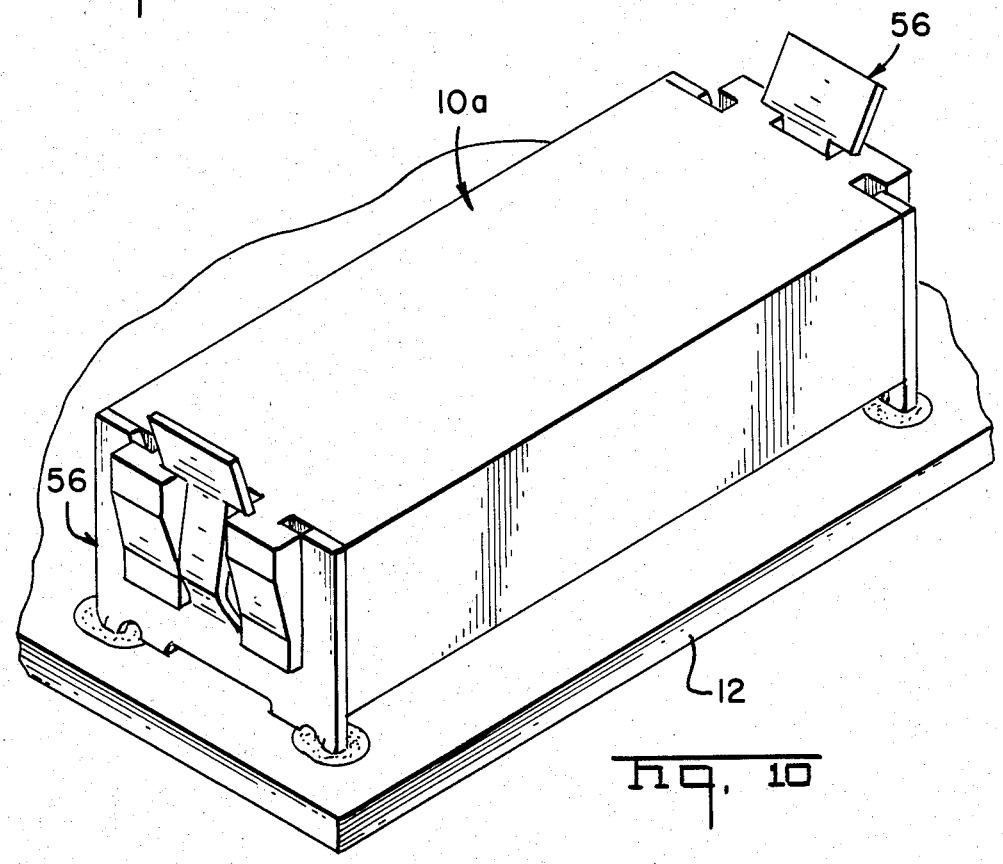

FIGS. 8 and 9 are fragmentary perspective views of further embodiments of the retainer of the present invention, and specifically illustrating two different embodiments for joining the lower edge portions of the retainers to the surface of a printed circuit board; and FIG. 10 is a perspective view illustrating an electrical component other than an electrical connector as described above, and which is mounted on the surface of a printed circuit board by the surface mounting means of the present invention.

Figure 1:
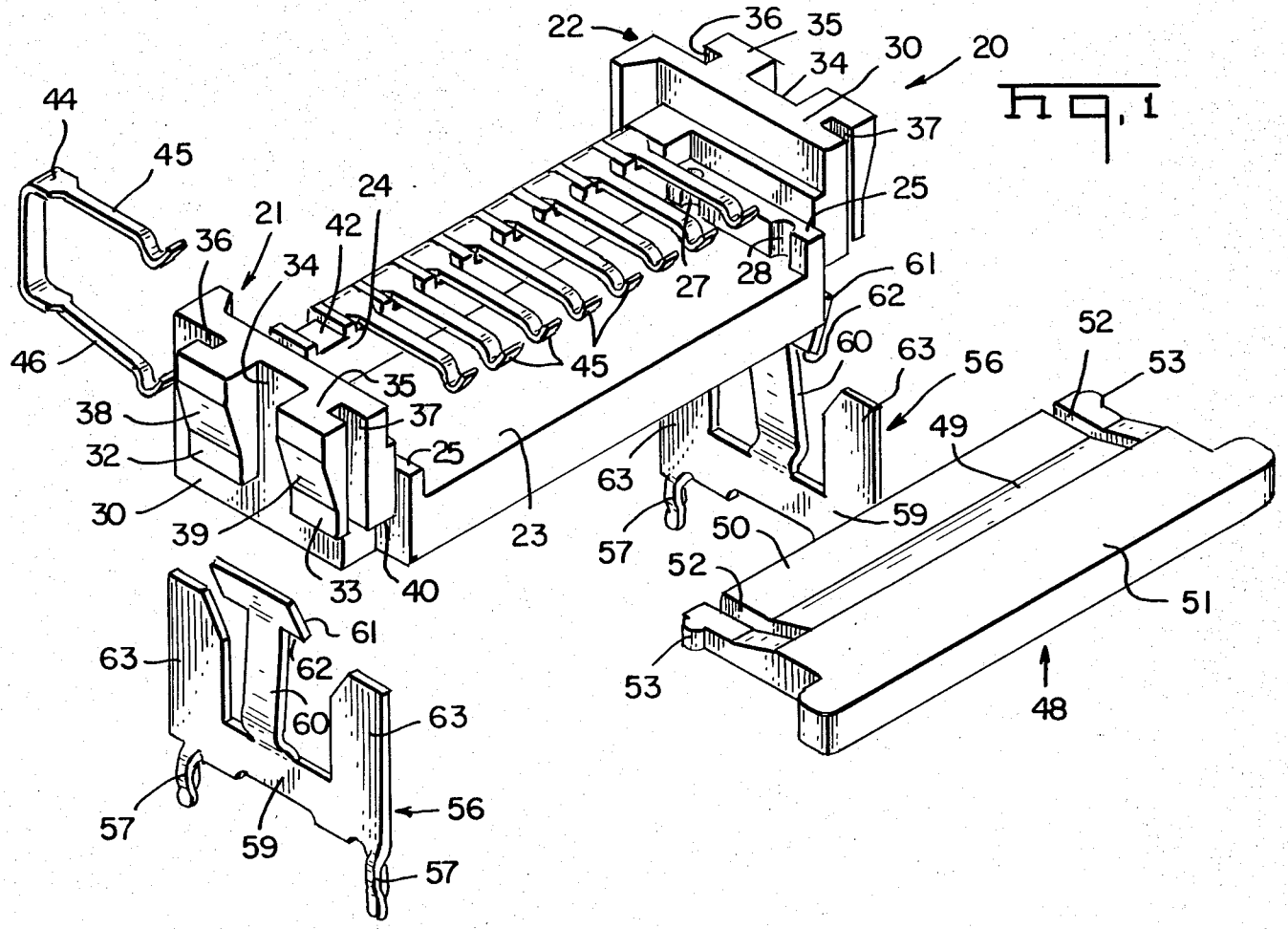
FIG. 1 is an exploded perspective view of an electrical connector which embodies the features of the present invention.
Figure 2:
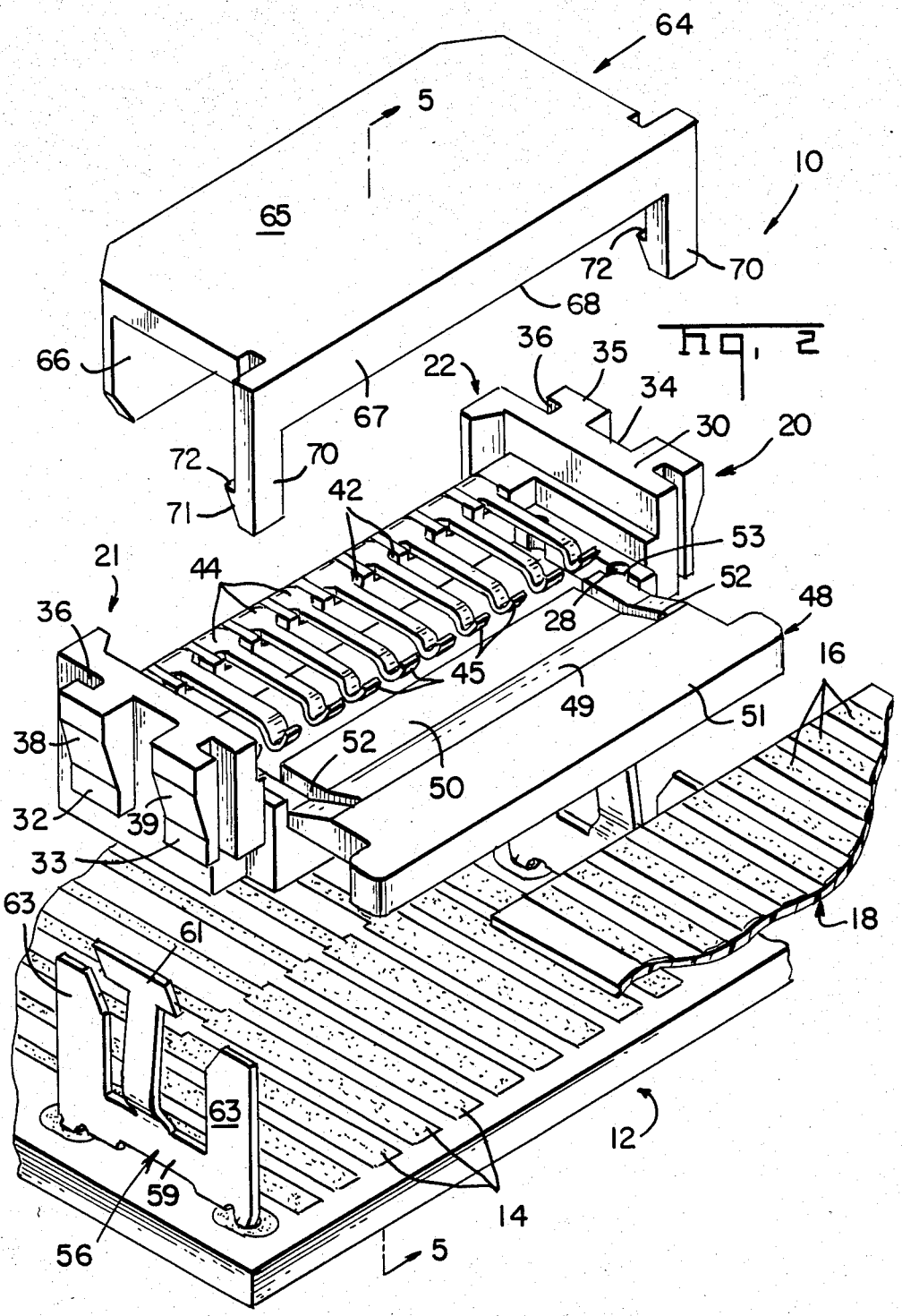
FIG. 2 is an exploded perspective view of the connector shown in FIG. 1 in a partially assembled condition, and further illustrating a cover for the connector.
Figure 3:
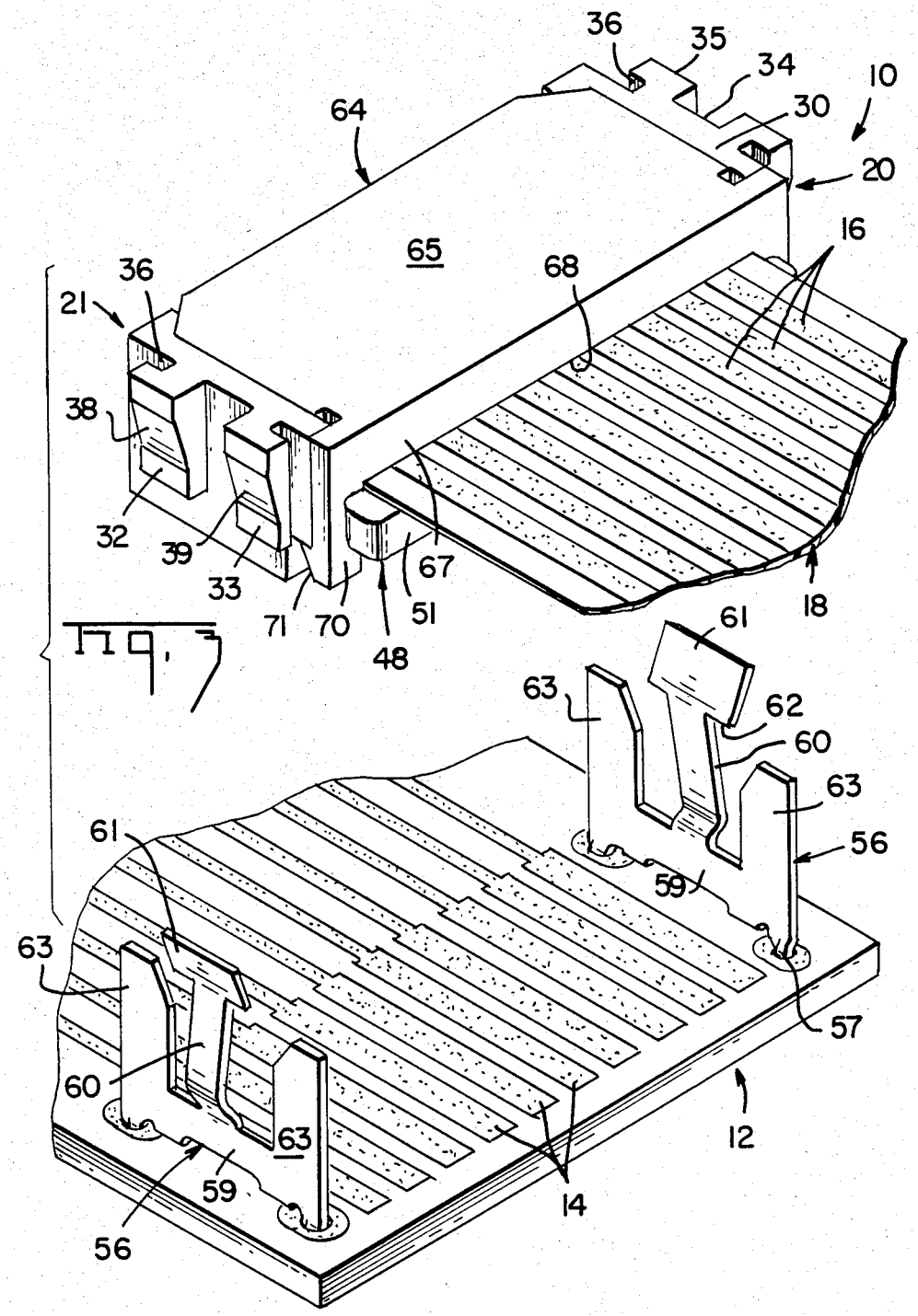
FIG. 3 is a view similar to FIG. 2, but illustrating the connector assembled to an external flexible flat cable, and prior to assembly on the circuit board.
Figure 4:
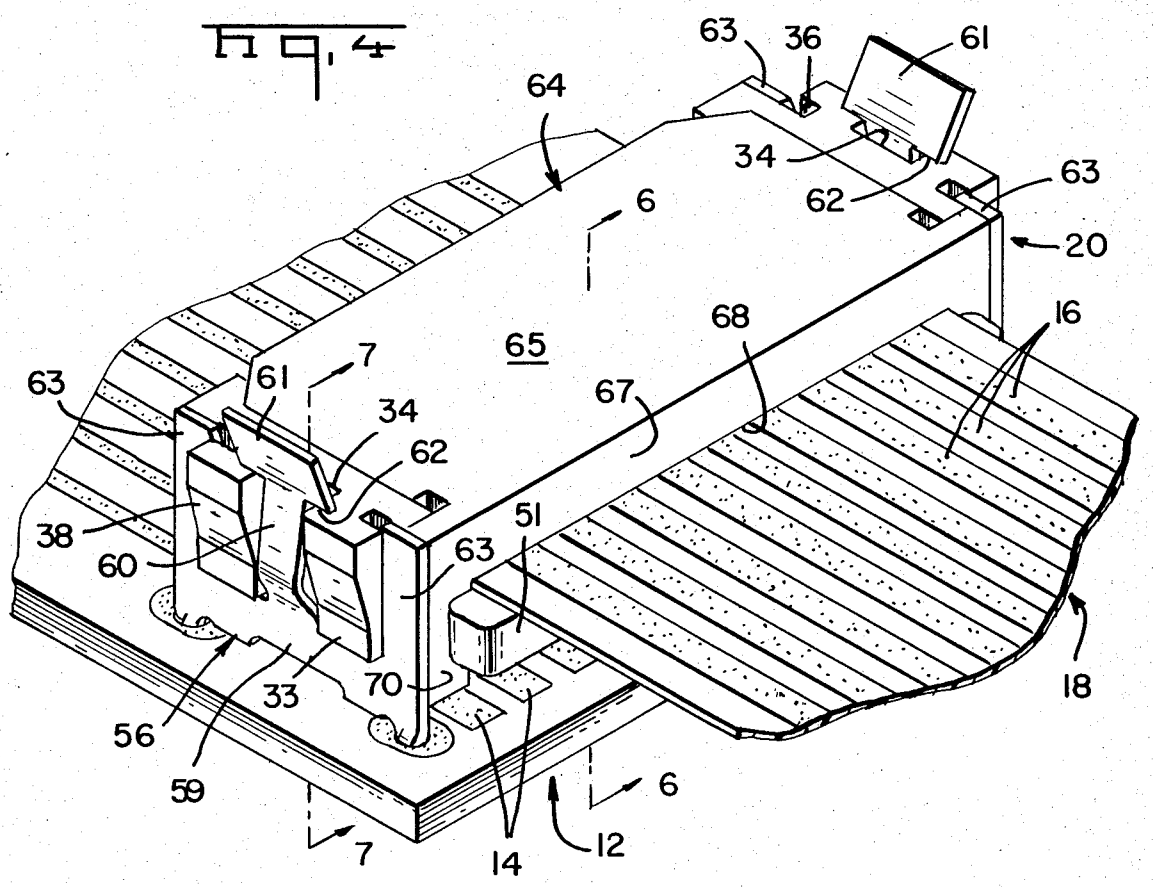
FIG. 4 is a view similar to FIG. 3, and illustrating the connector in its final assembled position on the circuit board.

Referring more particularly to the drawings, FIGS. 1 to 7 illustrate a preferred embodiment of an electrical connector 10 and surface mounting means in accordance with the features of the present invention. As best seen in FIGS. 2 to 4, the connector 10 is adapted to be mounted to the surface of a printed circuit board 12 for interconnecting a plurality of electrical conductors 14 on the circuit board to a like number of electrical conductors 16 in a flexible flat cable 18. In accordance with standard practice, the conductors 14 are disposed on centerlines which are spaced by 0.0050 inches, although different dimensions may of course be employed with the present invention.

In the illustrated embodiment, the connector 10 includes a body member 20 formed of a suitable insulating material, such as molded plastic. The body member comprises opposite end portions 21, 22 and a generally flat horizontal shelf 23 extending longitudinally therebetween. The body member further includes an upright back wall 24 which extends longitudinally along the back side of the shelf and between the end portions. Also, the ends of the upper surface of the shelf are defined by laterally extending ledges 25, which include a pair of laterally spaced apart open sockets 27, 28 adjacent the upper surface of the shelf for the purposes described below.

Each of the end portions 21, 22 of the body member includes an end wall 30, which is disposed generally perpendicularly to the longitudinal direction, and a pair of integral extensions 32, 33 are positioned on the outer face of the end wall. More particularly, the extensions 32, 33 are laterally spaced apart so as to define a vertically extending slot 34 therebetween, and the extensions have a coplanar upper edge surface 35. The side edge of each extension is spaced from the associated end wall 30 to define a vertically extending and laterally facing slot 36, 37 therebetween. The outer surfaces of the two extensions include aligned outwardly facing cam surfaces 38, 39, and the lower front corner of each end wall 30 is notched to form a downwardly directed shoulder 40, for the purposes described below.

As best seen in FIGS. 1, 2, 5 and 6, each of the rear, upper, and lower surfaces of the back wall 24 are grooved at a plurality of regularly spaced apart locations along its longitudinal length, and each such groove 42 is adapted to matingly receive the bight portion of a metal terminal 44 of generally U-shaped configuration. The terminals 44 thus define generally parallel legs 45, 46, with leg 45 of each terminal extending laterally across at least a portion of the shelf and in spaced relation thereto. Also, the legs 45 of the terminals collectively define an upper row of longitudinally spaced apart legs which overlies the shelf. The legs 46 of the terminals define a lower row of longitudinally spaced apart legs which is disposed below the shelf and so as to be exposed and extend below the body member.

The connector 10 further comprises a wedge plate 48, which is sized to overlie substantially the entire longitudinal and lateral dimensions of the shelf 23, and with the wedge plate being adapted to be laterally inserted between the shelf 23 and the upper row of legs 45. The lower surface of the wedge plate 48 is generally flat, and the upper surface includes an upper surface portion 49 which is inclined between a relatively thin forward edge portion 50 and a relatively thick rearward edge portion 51. Also, the opposite ends of the forward edge portion of the wedge plate are laterally slotted at 52, and the forward outer edge of the resulting finger mounts a detent 53 which is adapted to be received in one of the two sockets 27, 28 in the ledges 25 of the housing, and so that the wedge plate may be releasably retained in one of two positions, illustrated respectively in FIGS. 5 and 6.

Means are also provided for releasably mounting the connector 10 to the surface of a printed circuit board 12. In the illustrated embodiment, this surface mounting means includes a pair of retainers 56, with each retainer being composed of an integral, relatively thin sheet of metallic material and which includes a lower edge portion 59. A pair of downwardly directed pins 57 extend from the lower edge portion for fixedly mounting the retainers in apertures which extend through a circuit board in the embodiment of FIGS. 1 to 7. More particularly, the pins 57 of the retainers include oppositely upset portions which are adapted to be compressed and wedged in the aperture, to hold themselves in place. As illustrated in FIG. 7, each pin 57 extends through a hole 58, and the pins 57 may be soldered in the holes 58 as part of the conventional reflow soldering process as described above.

Each retainer further includes an upstanding spring arm 60 having an inclined surface 61 at the free end thereof, and which extends laterally beyond each side edge of the remaining portion of the arm 60 to define downwardly facing lower edges 62. Also, each retainer 56 includes a pair of upstanding flat side arms 63 positioned in spaced relation on opposite sides of the spring arm 60, with the inclined surface 61 positioned at an elevation above the free ends of the arms 63.

The illustrated embodiment of the connector 10 also includes a cover 64, which comprises a top wall 65, a rear wall 66 depending from the rear side of the top wall, a relatively short front wall 67 depending from the front side of the top wall and defining a downwardly facing front edge 68, note FIG. 5. Also, the cover includes a pair of longitudinally spaced apart posts 70 depending from the front corners of the top wall. The inner surface of each post includes an inclined surface 71 and upwardly facing ledge 72, which is adapted to latch beneath the shoulder 40 of the associated end portion of the housing to maintain the assembly of the cover to the housing in the manner further described below. Also, the under side of the top wall includes a plurality of laterally extending partitions 73 (note FIG. 6) which are adapted to fit between the upper legs 45 to maintain their separation when the cover is assembled to the housing 20. Further, the outside surface of the cover may be metalized to provide a shielded connector when the cover is used with at least one grounded retainer.

To now describe the method of assembling the connector 10 to the circuit board 12 and flexible flat cable 18, it will be understood that the circuit board 12 is designed so that it will include a row of exposed conductors 14 which are spaced apart to match the longitudinal spacing of the terminals 44 of the connector, which is typically 0.0050 inches as noted above. Also, a pair of retainers 56 will be mounted on the board at opposite ends of the row of conductors. In the illustrated embodiment, the pins 57 of the retainers 56 are inserted through the holes 58, and the pins are soldered thereto as part of the reflow soldering process.

It is generally preferred to next assemble the flexible cable 18 to the connector, although this step may alternatively be conducted after the connector is mounted on the board. For this purpose, the wedge plate 48 is initially moved to the position illustrated in FIGS. 2 and 5, with the spring detents 53 engaging the outer sockets 28 to maintain the positioning of the wedge on the shelf. An end portion of the flexible flat cable 18, which may be of a type having the conductors 16 exposed on the upper surface thereof, is then inserted laterally between the wedge plate 48 and the upper row of terminal legs 45, and to the position illustrated in FIG. 5. The wedge plate 48 is then advanced with the inclined surface 49 acting to press the flexible cable upwardly into firm contact with the legs 45, and so as to achieve a biased contact between each leg 45 and associated conductor 16 of the cable. When the position of FIG. 6 is reached, the spring detents 53 will engage the inner sockets 27, to maintain the positioning of the wedge plate.

Figure 6:
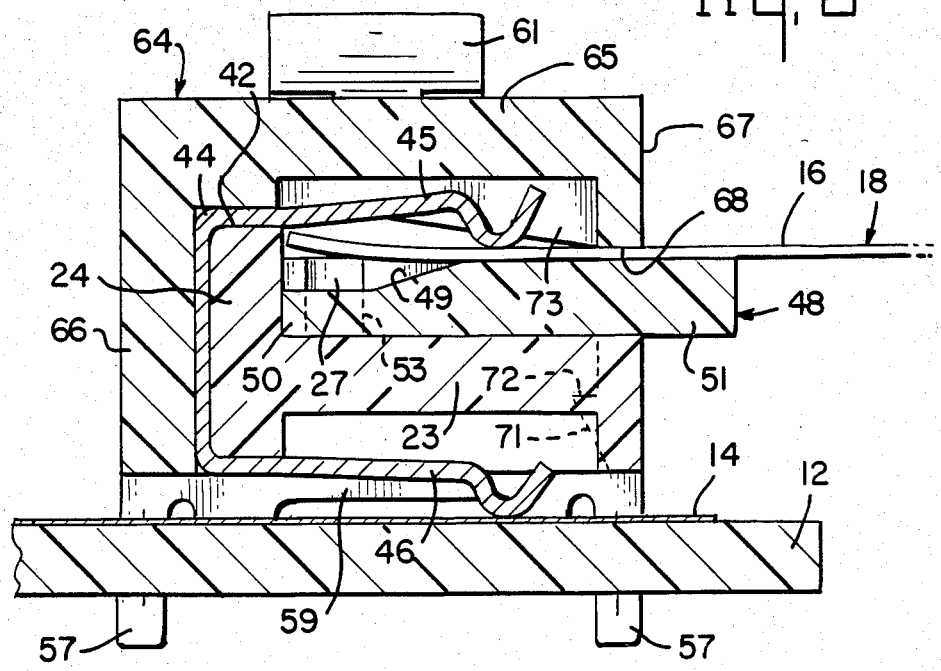
FIG. 6 is a sectional view taken substantially along the line 6—6 of FIG. 4.
Figure 7:
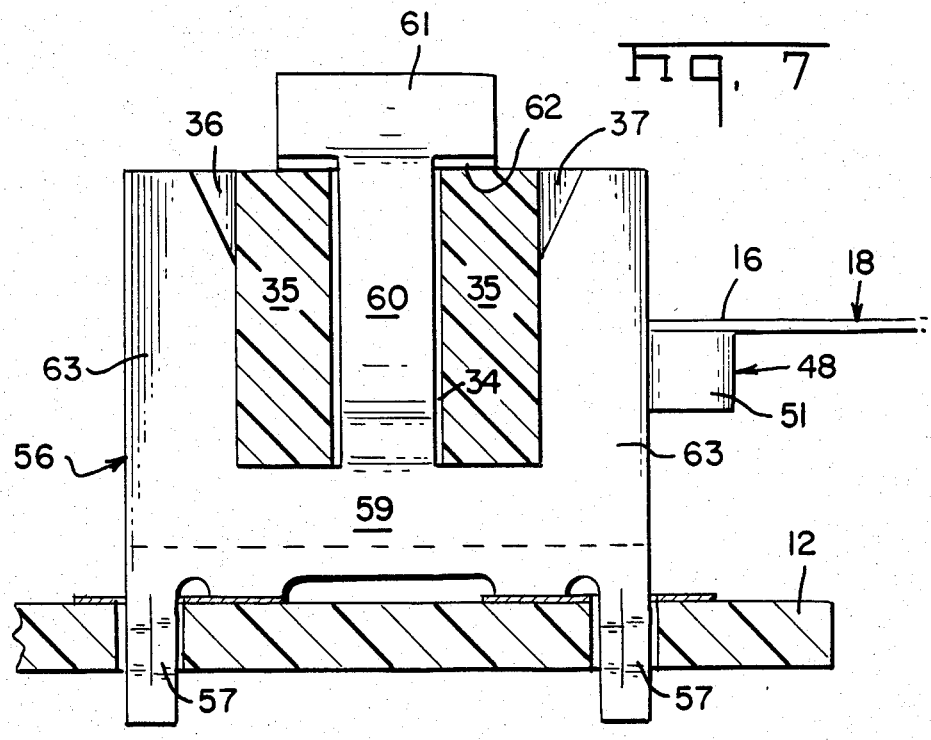
FIG. 7 is a sectional view taken substantially along the line 7—7 FIG. 4.

The cover 64 is mounted on the housing prior to the insertion of the wedge to its operative position, and so that the wedge presses the flexible cable 18 between the edge 68 of the cover and the wedge plate to resist the subsequent separation of the cable, note FIG. 6. The ledges 72 on the posts 70 of the cover latch beneath the shoulders 40 on the end portions of the housing, to maintain the assembly of the cover, and the partitions 73 maintain the separation of the legs 45.

The assembly resulting from the above steps, and as illustrated in the upper portion of FIG. 3, may then be mounted to the circuit board 12, by moving the assembly downwardly onto the board between the two retainers 56. During this downward movement, the spring arms 60 of the two retainers are sprung outwardly by the contact between the cam surfaces 38, 39 and the inclined surfaces 61, and upon reaching its desired position in contact with the board, the inclined surfaces 61 snap forwardly so that the edges 62 engage the upper edge surfaces 35 of the extensions. Also, it will be seen that the side arms 63 of the retainers will slide along the slots 36, 37 during the assembly operation, to further support the housing in its assembled position. Further, by reason of the fact that the lower row of terminal legs 46 extends below the body member 20 as best seen in FIG. 6, these terminal legs will be biased into contact with respective ones of the exposed conductors 14 on the board 12. In the event it is subsequently desired to remove the assembly from the board, the inclined surfaces 61 may be manually sprung outwardly, which permits the assembly to be readily lifted from the board.

FIGS. 8 and 9 illustrate alternative embodiments of the retainers of the present invention, and particularly, two different constructions for fixedly mounting the retainers to the circuit board. In FIG. 8, the retainer **56*a* includes a pair of legs 57*a* which are bent at right angles to the plane of the retainer. The legs 57*a* are adapted to be positioned on a solder strip 75 and so as to be soldered thereto during the reflow soldering process. The retainer 56*b* includes a pair of short legs 57*b*** which are adapted to be joined to the solder strip in the manner described above.

FIG. 10 illustrates an electrical component 10a joined to a circuit board by the surface mounting means of the present invention. In addition to an electrical connector as illustrated and described with respect to FIGS. 1 to 7, the component **10*a*** may comprise any other component which is to be mounted on the board, such as a conventional chip carrier, capacitor, resistance element and the like.

In the drawings and specification, there has been set forth a preferred embodiment of the invention, and although specific terms are employed, they are used in a generic and descriptive sense only, and not for purposes of limitation.

That which is claimed is:

1. An electrical assembly including an electrical connector which is adapted to be mounted to the surface of a printed circuit board for interconnecting a plurality of conductors on the circuit board to a like number of conductors in a flexible flat cable, and comprising an electrical connector comprising a body member having opposite end portions and a generally flat shelf extending longitudinally between said end portions, a plurality of metal terminals, with each of said terminals having a generally U-shaped configuration so as to define a pair of generally parallel legs, means mounting said terminals to said body member in a longitudinally spaced apart and aligned arrangement, and with a first one of the legs of each terminal extending laterally across at least a portion of said shelf and so that the first legs of the terminals define an upper row of longitudinally spaced apart legs which overlie said shelf, and with the second ones of the legs of the terminals defining a lower row of longitudinally spaced apart legs which is disposed below said shelf and so as to be exposed below said housing, and a wedge plate sized to overlie substantially the entire longitudinal and lateral dimensions of said shelf, and with the wedge plate being adapted to be laterally inserted between said shelf and said upper row of legs, and means for mounting said connector to a printed circuit board or the like, whereby a flexible flat cable comprising a row of conductors may be electrically connected to said connector by the steps of exposing the conductors of the cable at an end portion thereof, and laterally inserting such end portion and the wedge plate between the shelf and the upper row of contact legs and so that the terminal legs of said upper row egage respective ones of the conductors of the cable, and wherein the connector and assembled cable may be mounted on a circuit board having a row of conductors on the surface thereof and with such conductors on the board being respectively engaged by the lower row of terminal legs.

2. The electrical assembly as defined in claim 1 wherein said means for mounting said body member to a printed circuit board comprises a pair of retainers, with each retainer including means adapted for contacting and being fixedly mounted to the surface of a printed circuit board or the like, and spring arm means for releasably engaging one of the end portions of said body member.

3. The electrical assembly as defined in claim 2 wherein each of said end portions of said body member comprises an end wall disposed generally perpendicular to the longitudinal direction, and a pair of integral extensions on the outer face of each end wall, with said extensions being laterally spaced apart to define a vertically extending slot therebetween and further having aligned outwardly facing cam surfaces and upper edge surfaces, and wherein said spring arm means of each retainer comprises an upstanding spring arm having an inclined surface at the free end thereof, and such that the connector may be mounted on the circuit board between two aligned retainers which are fixed thereto, by moving the connector onto the circuit board between the retainers and such that the inclined surfaces of the retainers engage the outwardly facing cam surfaces of the associated end portions and the spring arms are biased outwardly and then snap back into a locked position in engagement with the upper edge surfaces of the extensions.

4. The electrical assembly as defined in claim 3 wherein each of said end portions of said body member further includes a vertically extending and laterally facing slot formed between each extension and the associated end wall, and wherein each retainer further includes a pair of upstanding side arms on opposite sides of said spring arm, and with said side arms being adapted to be received in respective ones of said laterally facing slots during assembly of the connector to the circuit board.

5. The electrical assembly as defined in claim 2 wherein said connector further comprising a separate cover, and means for releasably mounting said cover in an operative position overlying and covering said shelf and said upper row of terminal legs.

6. The electrical assembly as defined in claim 5 wherein said cover includes a longitudinally extending front edge which is adapted to overlie said shelf in said operative position, and such that the end portion of the flexible flat cable is adapted to be clamped between said front edge and said wedge plate when said cover is in its operative position.

7. The electrical assembly as defined in claim 2 wherein said wedge plate includes an upper surface having an inclined surface portion, and such that the inclined surface portion is adapted to bias the conductors of the flexible flat cable into contact with the legs of said upper row when the cable and wedge plate are inserted between said shelf and said upper row of contact legs.

8. The electrical assembly as defined in claim 2 wherein said housing and wedge plate include cooperating spring detent means for releasably retaining said wedge plate in its operative position between said shelf and said upper row of contact legs.

9. The electrical assembly as defined in claim 2 wherein said means mounting said terminals to said body member comprises an upright back wall extending longitudinally along one side of said shelf, and with said back wall having an outline configured to mate with the bight portion of said terminals and such that the terminals may be assembled to said back wall with the legs extending laterally therefrom.

10. The electrical assembly as defined in claim 9 wherein said upright back wall includes a plurality of longitudinally spaced apart grooves, with the grooves being adapted to receive tha portion of the terminals which contact the back wall, to thereby maintain the longitudinal separation and alignment of the terminals.

11. An electrical assembly adapted to be releasably mounted to the surface of a printed circuit board, and comprising an electrical component having opposite end portions and defining a longitudinal direction extending therebetween, each of said end portions of said component having an end wall disposed generally perpendicularly to the longitudinal direction, said extension means having an outwardly facing cam surface means, and integral extension means on the outer face of each end wall and which includes an upper edge surface, and vertically extending and laterally facing slot means therein;

means for releasably mounting said component to a printed circuit board or the like, and including a pair of retainers, with each retainer including means adapted for contacting and being fixedly mounted to the surface of a printed circuit board or the like, and spring arm means adapted for releasably engaging said cam surface means of the associated end portion of said component, said spring arm means being comprised of an upstanding spring arm having a surface portion which includes a lower edge, and such that the surface portions of the retainers may be sprung outwardly to permit movement of the component between the retainers, and such that the surface portions are adapted to snap back into a locked position with said lower edges of said surface portions overlying the upper edge surfaces of the extension means in an assembled position said retainers further including upstanding side arm means which is adapted to be received in said slot means of the associated end portion;

whereby the retainers may be fixedly mounted on the surface of a printed surface board in a spaced apart arrangement conforming to the longitudinal length of the component, and the component may be mounted on the surface between the pair of retainers by the engagement between the retainers and the end portions of the component.

12. An electrical assembly adapted to be releasably mounted to the surface of a printed circuit board, and comprising an electrical component having opposite end portions and defining a longitudinal direction extending therebetween, each of said end portions of said component comprising an end wall disposed generally perpendicular to the longitudinal direction, and a pair of integral extensions on the outer face of each end wall, with said extensions being laterally spaced apart to define a vertically extending slot therebetween and further having aligned outwardly facing cam surfaces and upper edge surfaces, each of said end portions further including a vertically extending and laterally facing slot formed between each extension and the associated end wall.

means for releasably mounting said component to a printed circuit board or the like, and including a pair of retainers, with each retainer including means adapted for contacting and being fixedly mounted to the surface of a printed circuit board or the like, and spring arm means adapted for releasably engaging one of the end portions of said component, said spring arm means of each retainer comprising an upstanding spring arm having an inclined surface at the free end thereof, each retainer further including a pair of upstanding side arms on opposite sides of said spring arm, with said side arms being adapted to be received in respective ones of said laterally facing slots during assembly of the component to the circuit board, whereby the retainers may be fixedly mounted on the surface of a printed circuit board in a spaced apart arrangement conforming to the longitudinal length of the component, and the component may be mounted on the circuit board between two aligned retainers which are fixed thereto, by moving the component onto the circuit board between the retainers and such that the inclined surfaces of the retainers engage the outwardly facing cam surfaces of the associated end portions and the spring arms are biased outwardly and then snap back into a locked position in engagement with the upper edge surfaces of the extensions.

13. A retainer adapted for releasably mounting an electrical component on the surface of a printed circuit board or the like, and comprising an integral, relatively thin sheet of material which includes a lower edge portion which includes means adapted for contacting and being fixedly mounted to the surface of a printed circuit board or the like, spring arm means extending upwardly from said lower edge portion, said spring arm means including an inclined surface portion at the upper free end thereof which is inclined with respect to the remainder of said retainer, an upstanding side arm extending upwardly from said lower edge portion in spaced relation on each side of said spring arm means, component engaging slot means formed by opposed side edges of said side arms of said retainer, said component engaging slot means located for cooperating with retainer engaging extension means located on outer faces of end portions of said electrical component;

whereby a pair of said retainers are adapted to be fixedly mounted on the surface of a circuit board in a spaced apart arrangement, and an electrical component having end portions configured to matingly engage said component engaging slot means of said retainers may be mounted on the surface between the retainers.

14. The retainer as defined in claim 13 wherein said means adapted for contacting and being fixedly mounted to the surface of a printed circuit board comprises a pair of spaced legs extending downwardly from said lower edge portion.

15. The retainer as defined in claim 13 wherein said inclined surface portion of said spring arm means is positioned at an elevation above the free ends of said upstanding side arms.

16. An electrical connector for connecting conductive members of a circuit board with conductive members of a flat electrical cable, comprising:

dielectric body means having electrical terminal means supported by said body means, said terminal means including first contact means extending along an upper section of said body means for electrical connection with respective conductive members of the flat cable and second contact means extending along a lower section of said body means for electrical connection with respective conductive members of the circuit board;

retaining means having mounted means for mounting said retaining means onto the circuit board;

latching means on said retaining means cooperable with latching section means of said body means for releasably latching said body means onto the circuit board; and support means cooperable with support-engaging means of said body means for supporting said body means on the circuit board, said support means comprising upstanding side arms extending upwardly from a lower edge portion of said retaining means, one said side arm on each side of said latching means and said support engaging means comprising integral extension means extending outwardly from body end portions of said body means, said extension means having vertically extending and laterally facing slot means which are adpated to receive the two associated said side arms during assembly of the connector to the circuit board.

17. An electrical connector as defined in claim 16 wherein said retaining means includes a lower edge portion and said latching means comprises a spring arm means extending upwardly from said lower edge portion, and wherein said body means includes oppositely facing and spaced apart end portions, said end portions having outwardly directed latching sections thereon whereby said spring arm means cooperates with said latching section to latch said body means to the circuit board.

18. An electrical connector as defined in claim 17 wherein said support means comprises an upstanding side arm extending upwardly from said lower edge portion of said retaining means and on each side of said spring arm means and wherein said support engaging means is comprised of integral extension means extending outwardly from said body end portions, said extension means having vertically extending and laterally facing slot means which are adapted to receive the associated said side arm during assembly of the connector to the circuit board.

19. The electrical connector as defined in claim 16 wherein said body means includes oppositely facing vertical end portions; a generally flat shelf which extends longitudinally between said end portions in the upper section of said body means such that said first contact means lie over at least a portion of said shelf; and a wedge means sized to overlie substantially the entire longitudinal and lateral dimension of said shelf, the wedge means being adapted to be laterally inserted between said shelf and said first contact means whereby conductive members of a flat cable may be electrically connected to respective first contact means by inserting an end of the cable between said shelf and said first contact members and inserting the wedge between said shelf and said cable so that the first contact means engage respective conductive members of the cable.

20. The electrical connector as defined in claim 19 wherein said connector is further comprised of a separate cover means and means for releasably mounting said cover in an operative position overlying and covering said shelf and said first contact members.

21. The electrical connector as defined in claim 20 wherein said cover means includes a longitudinally extending front edge which is adapted to overlie said shelf in said operative position, and such that the end portion of the flat cable is adapted to be clamped between said front edge and said wedge means when said cover is in its operative position.

* * * * *